US011045866B2

(12) United States Patent
Hanai et al.

(10) Patent No.: US 11,045,866 B2
(45) Date of Patent: Jun. 29, 2021

(54) METHOD FOR PREVENTING DEFECT CAUSED BY SHIFT IN CAVITY PARTS

(71) Applicant: Sintokogio, Ltd., Aichi (JP)

(72) Inventors: Takashi Hanai, Aichi (JP); Takehiro Sugino, Aichi (JP); Kazunori Ogura, Aichi (JP); Yoshimitsu Ichino, Aichi (JP); Shuji Takasu, Aichi (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 16/965,871

(22) PCT Filed: Nov. 15, 2018

(86) PCT No.: PCT/JP2018/042222
§ 371 (c)(1),
(2) Date: Jul. 29, 2020

(87) PCT Pub. No.: WO2019/163221
PCT Pub. Date: Aug. 29, 2019

(65) Prior Publication Data

US 2021/0053108 A1 Feb. 25, 2021

(30) Foreign Application Priority Data

Feb. 23, 2018 (JP) ..... JP2018-030258

(51) Int. Cl.
*B22C 19/04* (2006.01)
*B22C 21/10* (2006.01)
(Continued)

(52) U.S. Cl.
CPC ..... *B22C 19/04* (2013.01); *B22C 21/10* (2013.01); *B22D 46/00* (2013.01); *B22D 47/02* (2013.01)

(58) Field of Classification Search
CPC ..... B22C 19/04; B22C 21/10; B22C 11/00; B22C 11/10; B22D 46/00; B22D 47/02
See application file for complete search history.

(56) References Cited

U.S. PATENT DOCUMENTS 6,015,007 A * 1/2000 Hunter ..... B22C 19/04 164/151.2

FOREIGN PATENT DOCUMENTS

CN 102159344 A 8/2011
CN 108348987 A 7/2018
(Continued)

OTHER PUBLICATIONS

International Search Report for International Application No. PCT/JP2018/042222 dated Feb. 5, 2019.

*Primary Examiner* — Kevin P Kerns
*Assistant Examiner* — Steven S Ha
(74) *Attorney, Agent, or Firm* — Finnegan, Henderson, Farabow, Garrett & Dunner, LLP

(57) ABSTRACT

A method is provided for measuring a shift between a carrier for a pattern (a carrier plate) and a flask and preventing a defect caused by a shift in the cavity parts. The method for preventing a defect caused by the shift in the cavity parts in molding a cope and a drag with flasks by using a cope flask (110) that is assembled with a carrier plate (130) for the cope flask and a drag flask (120) that is assembled with a carrier plate (140) for the drag flask, comprises the steps of measuring a shift between the carrier plate (130) for the cope flask and the cope flask (110), measuring a shift between the carrier plate (140) for the drag flask and the drag flask (120), measuring a shift between the cope flask (110) and the drag flask (120) that have been assembled, determining if a shift in cavity parts is within an allowable range, wherein the data on the shift is obtained based on the shift between the carrier plate (130) for the cope flask and the cope flask (110), the
(Continued)

shift between the carrier plate (140) for the drag flask and the drag flask (120), and the shift between the cope flask (110) and the drag flask (120, that have been assembled.

7 Claims, 14 Drawing Sheets

(51) Int. Cl.
*B22D 46/00* (2006.01)
*B22D 47/02* (2006.01)

(56) References Cited

FOREIGN PATENT DOCUMENTS

| | | | |
|---|---|---|---|
| JP | 56-6757 | A | 1/1981 |
| JP | H 05-212492 | A | 8/1993 |
| JP | H 09-103844 | A | 4/1997 |
| JP | 2001-321927 | | 11/2001 |
| JP | 2010-069519 | A | 4/2010 |
| KR | 10-2018-0103832 | A | 9/2018 |
| WO | WO 2010/032544 | A1 | 3/2010 |
| WO | WO 2017/122510 | A1 | 7/2017 |

* cited by examiner

METHOD FOR PREVENTING DEFECT CAUSED BY SHIFT IN CAVITY PARTS

TECHNICAL FIELD

The present invention relates to a method for preventing a defect that is caused by a shift in cavity parts when molding. Specifically, it relates to a method for estimating a shift in cavity parts to prevent a defect that may be caused by the shift.

BACKGROUND ART

In a foundry, a line for molding that molds a cope and a drag, especially a line for molding a cope and a drag with flasks, assembles a carrier for a pattern (a carrier plate), which is mounted on it, and a flask for a cope flask and a carrier for a pattern and a flask for a drag flask. It fills a molding space that is formed by means of the flask, the carrier plate, and a squeeze board with molding sand to separately mold a cope and a drag. Then it assembles the cope and the drag. Molten metal is poured into the cope and the drag to manufacture a cast product.

If a shift occurs when the carrier for a pattern and the flask are assembled, the cavity part, which is a space to manufacture a cast product when molten metal is poured, is shifted in relation to the flask. Thus a shift between the cavity part of the cope and that of the drag occurs when the cope flask and drag flask are assembled. Incidentally, the term "a shift in cavity parts" means a shift between a cavity part of a cope and that of a drag, unless otherwise stated. Further, if a shift occurs between a cope flask and a drag flask when they are assembled, a shift occurs between the cope and the drag even when the positions of the cavity parts are at their set positions in the cope and the drag. Thus, a shift occurs between the cavity part of the cope and that of the drag. A shift in cavity parts causes a cast product to be defective. Therefore, a method has been provided to prevent a shift between a carrier for a pattern and a flask and between a cope flask and a drag flask, wherein a pin and a bushing are provided to a carrier for a pattern and a flask, to fit the pin with the bushing.

However, since a carrier for a pattern and a flask are repeatedly used, a pin or a bushing may be worn out, so that a shift may easily occur. Thus, to analyze molding information, a system was proposed to detect the degree of wear of a pin and a bushing of the flasks during the operation of a line for the molding so that the data on the degree are sent through a network to be monitored (see Patent Literature 1).

However, the pin and bushing may not be uniformly worn out. Thus, when they are worn out a shift between the cavity parts does not always occur.

Thus, the object of the present invention is to provide a method for preventing a defect that is caused by a shift in cavity parts, by measuring shifts between a carrier for a pattern and a flask and between a cope flask and a drag flask.

PRIOR-ART PUBLICATION

Patent Literature

[Patent Literature 1]
Japanese Patent Laid-open Publication No. 2001-321927

SUMMARY OF INVENTION

To achieve the above-mentioned object, a method for preventing a defect caused by a shift in cavity parts of a first aspect of the present invention is, for example, as in FIGS. 2, 3, 9, and 12, the method in molding a cope and a drag with flasks by using a cope flask 110 that is assembled with a carrier plate 130 for the cope flask and a drag flask 120 that is assembled with a carrier plate 140 for the drag flask. The method comprises a step of measuring a shift between the carrier plate 130 for the cope flask and the cope flask 110. It also comprises a step of measuring a shift between the carrier plate 140 for the drag flask and the drag flask 120. It also comprises a step of measuring a shift between the cope flask 110 and the drag flask 120 that have been assembled. It also comprises a step of determining if a shift in cavity parts is within an allowable range, wherein the data on the shift is obtained based on the shift between the carrier plate 130 for the cope flask and the cope flask 110, the shift between the carrier plate 140 for the drag flask and the drag flask 120, and the shift between the cope flask 110 and the drag flask 120, that have been assembled.

By the above configuration, since any shift in the cavity parts is determined to see if it is within an allowable range, wherein the data on the shift is obtained based on the measured shifts between the carrier plates for the cope and drag flasks and the cope and drag flasks and the measured shift between the cope flask and the drag flask that have been assembled, a defect caused by a shift in cavity parts can be prevented.

By the method for preventing a defect caused by a shift in cavity parts of a second aspect of the present invention, for example, as in FIGS. 2, 3, 9, and 12, the carrier plate 130 for the cope flask and the cope flask 110 may be positioned in relation to each other by means of a male jig 112 for the positioning and a female jig 132 for the positioning. The carrier plate 140 for the drag flask and the drag flask 120 may be positioned in relation to each other by means of a male jig 142 for the positioning and a female jig 122 for the positioning. The cope flask 110 and the drag flask 120 are positioned in relation to each other by means of a male jig 112 for the positioning and a female jig 122 for the positioning. By this configuration, since the cope and drag flasks and the carrier plates for the cope and drag flasks and the cope and drag flasks are positioned by means of the male jigs for the positioning and the female jigs for the positioning, a shift cannot easily occur, to thus prevent a defect caused by the shift in the cavity parts.

The method for preventing a defect caused by a shift in cavity parts of a third aspect of the present invention, for example, as in FIGS. 5, 6, and 7, may further comprise a step of measuring a degree of wear of the male jig 112, 142 for the positioning or the female jig 122, 132 for the positioning of any of the carrier plate 130 for the cope flask, the cope flask 110, the carrier plate 140 for the drag flask, and the drag flask 120. By this configuration, since the degree of wear of the male jig for the positioning or the female jig for the positioning is measured, whether the shift occurs due to wear can be found.

By the method for preventing a defect caused by a shift in cavity parts of a fourth aspect of the present invention, for example, as in FIGS. 5, 6, and 7, an outer periphery of the male jig 112, 142 for the positioning or an inner periphery of the female jig 122, 132 for the positioning may be measured in the step of measuring the degree of wear. By this configuration, since the outer periphery of the male jig for the positioning or the inner periphery of the female jig for the positioning is measured to find the degree of the wear, the degree of the wear can correctly be measured even when the jigs are unevenly worn out.

The method for preventing a defect caused by a shift in cavity parts of a fifth aspect of the present invention, for example, as in FIG. 12, may further comprise a step of generating an alarm if the degree of wear of the male jig 112, 142 for the positioning or the female jig 122, 132 for the positioning is outside the allowable range. By this configuration, since an alarm is generated if the degree of wear of the male jig for the positioning or the female jig for the positioning is outside the allowable range, the state wherein the degree of wear is great can be found.

The method for preventing a defect caused by a shift in cavity parts of a sixth aspect of the present invention, for example, as in FIG. 12, may further comprise a step of linking the degree of wear of the male jig 112 for the positioning or the female jig 122 for the positioning to the cope flask 110 or the drag flask 120 that has that male jig 112 for the positioning or that female jig 122 for the positioning, so as to find a flask in which the male jig 112 for the positioning or the female jig 122 for the positioning should be exchanged during the maintenance of a line for molding a cope and a drag with flasks. By this configuration, since a cope flask or a drag flask of which the male jig for the positioning or the female jig for the positioning has been worn out can be easily found, an inspection and an exchange can effectively be carried out.

The method for preventing a defect caused by a shift in cavity parts of a seventh aspect of the present invention, for example, as in FIG. 12, may further comprise a step of comparing respective shapes that have been found based on the measured values on the outer periphery of the male jig 112, 142 for the positioning and on the inner periphery of the female jig 122, 132 for the positioning with at least one of the measured shift between the carrier plate 130 for the cope flask and the cope flask 110, the measured shift between the carrier plate 140 for the drag flask and the drag flask 120, and the measured shift between the cope flask 110 and the drag flask 120, that have been assembled. By this configuration, the validation of the result of the measured shift can be judged based on the comparison of the shape of the male jig for the positioning or the female jig for the positioning with the shift.

The present invention comprises the steps of measuring a shift between a carrier plate for a cope flask and the cope flask, measuring a shift between a carrier plate for a drag flask and the drag flask, measuring a shift between the cope flask and the drag flask that have been assembled, and determining if a shift in cavity parts is within an allowable range, wherein the data on the shift is obtained based on the shift between the carrier plate for the cope flask and the cope flask, the shift between the carrier plate for the drag flask and the drag flask, and the shift between the cope flask and the drag flask that have been assembled. Thus, the shift in cavity parts is found based on the measurements on the shift between the cope and drag flasks and the carrier plate and on the shift between the cope and drag flasks that have been assembled, to determine if it is within the allowable range. Thereby, a defect that is caused by the shift in cavity parts can be prevented.

The basic Japanese patent application, No. 2018-030258, filed Feb. 23, 2018, is hereby incorporated by reference in its entirety in the present application.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural form of a noun, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

DESCRIPTION OF EMBODIMENTS

Figure 1:
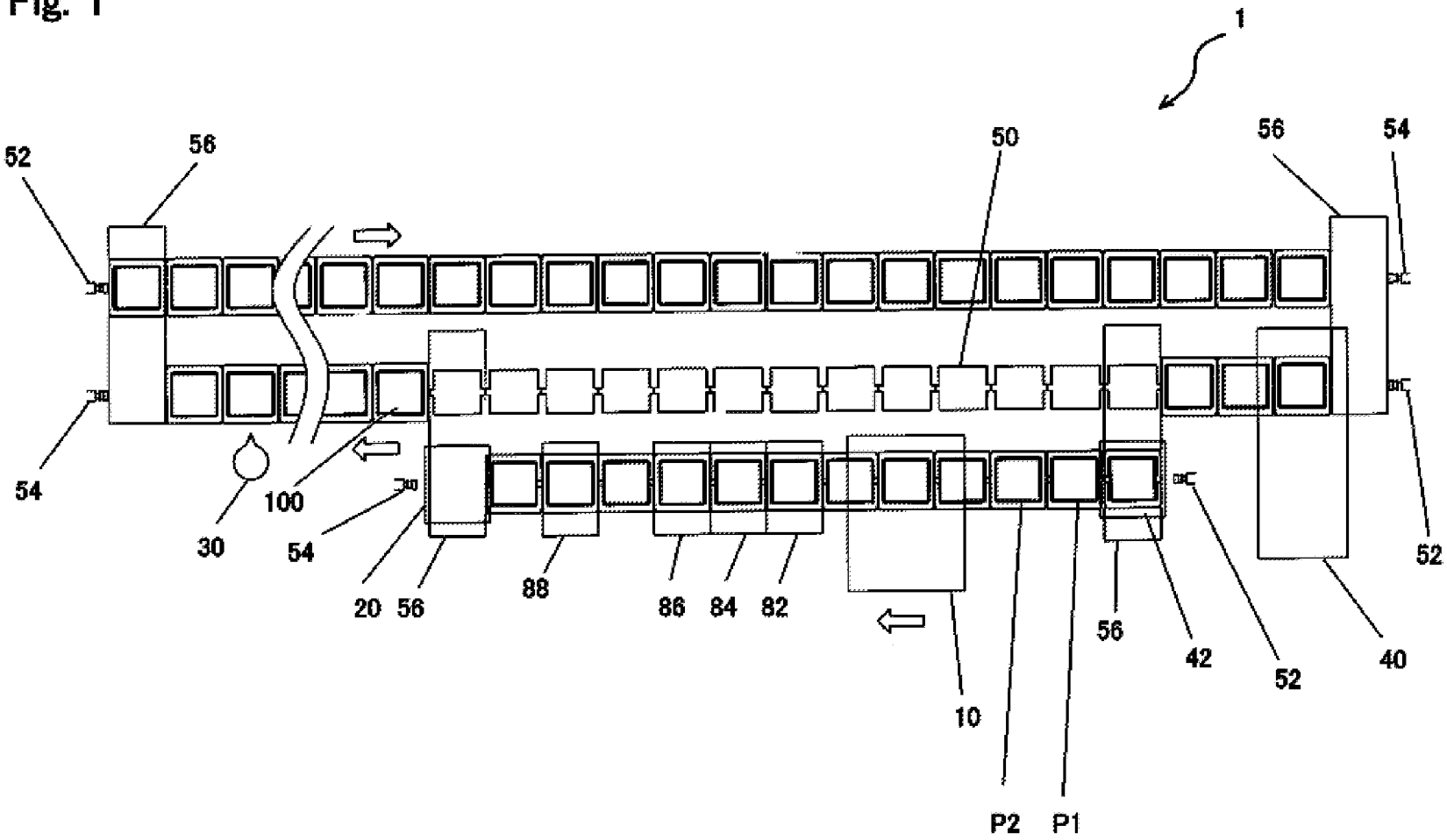
FIG. 1 is a plan view illustrating a line for the molding.

Below the embodiments of the present invention are discussed with reference to the drawings. In the drawings, the same or corresponding members are denoted by the same reference numbers. Thus, duplicate descriptions are omitted.

First, with reference to FIG. 1, an embodiment of a line for molding molds is discussed. The line 1 for the molding alternately molds a cope and a drag with flasks. In the drawing, the arrow defined by the outline denotes the direction to convey the molds or the flasks. The same denotation is applicable to the other drawings.

In the line 1 for the molding, a molding machine 10 is provided that molds the cope and drag (the mold) from molding sand. A pouring machine 30 is also provided that pours molten metal into the mold. A shake-out machine 40 is also provided that breaks the mold to separate a cast product from the molding sand after the molten metal has been cooled and has solidified to form a cast product. Between the machines 10, 30, 40, the mold is conveyed by a roller conveyor, which is not shown, or transported by being mounted on a carriage 50 with a molding board. A plurality of the carriages 50 with a molding board are arranged on rails (not shown) that are disposed in parallel. The carriages 50 with a molding board, which form a line, are pushed out by a pusher 52 that is provided at the end of a side for pushing out. Thus the carriages 50 with a molding board in a line, i.e., the cope and drag 100, are transported by a distance that is equal to the length of a mold. Incidentally, a cushion 54 that shrinks when the pusher 52 pushes is preferably provided at the end of a side for taking out, to sandwich the carriages 50 with a molding board in a line. By so doing the carriage 50 with a molding board is stable during the transportation.

Traversers 56 are provided at both ends of the line of the carriages 50 with a molding board to transfer the carriage 50 to a rail that is parallel to and next to the rail on which the carriages 50 are arranged. The carriage 50 with a molding board that comes to the end of the line is transferred to the head of the line of the carriages 50 on the next rail by means of the traversers 56.

In the line 1 for the molding, a roll-over machine 82 is provided that inverts the mold (the two pieces, the cope and the drag) that has been molded by the molding machine 10, i.e., upside down (roll over it about an axis that runs in a direction to transport the flasks), so that the mold upwardly faces the cavity parts. In the line 1 for the molding, a sand cutter 84 is further provided to remove excess sand on the surfaces of the cavities of the cope and the drag. The sand cutter 84 may treat only the drag. In the line 1 for the molding, a sprue-forming machine 86 that forms a sprue in the cope is further provided. In the line 1 for the molding, a machine 88 for re-rolling over the cope flask is provided to re-roll over the cope (re-roll over it about an axis that runs in a direction to transport the flasks), so that its cavity part faces downwardly, to be placed on the drag. In the line 1 for the molding, a mold-assembling device 20 is provided so that the drag is mounted on the carriage 50 with a molding board so that the cope that has been rolled over by means of the machine 88 for re-rolling over the cope flask is placed on the drag, and so that the cope and drag 100 are formed.

Molten metal is poured into the cope and drag 100 that are transported on the line 1 for the molding from the pouring machine 30. The cope and drag 100 into which molten metal has been poured are transported for a set distance. While they are transported for a set time, the molten metal that has been poured is cooled and solidifies, to form a cast. The cope and drag 100 in which the molten metal has solidified are drawn out from the cope and drag flasks (collectively called "the flask") by the shake-out machine 40. They are further broken so that a cast is taken out and the molding sand is sent to a device for sand preparation (not shown). The cope flask and the drag flask are alternately arranged by a machine 42 for separating the flask, to be returned to the molding machine 10.

Figure 2:
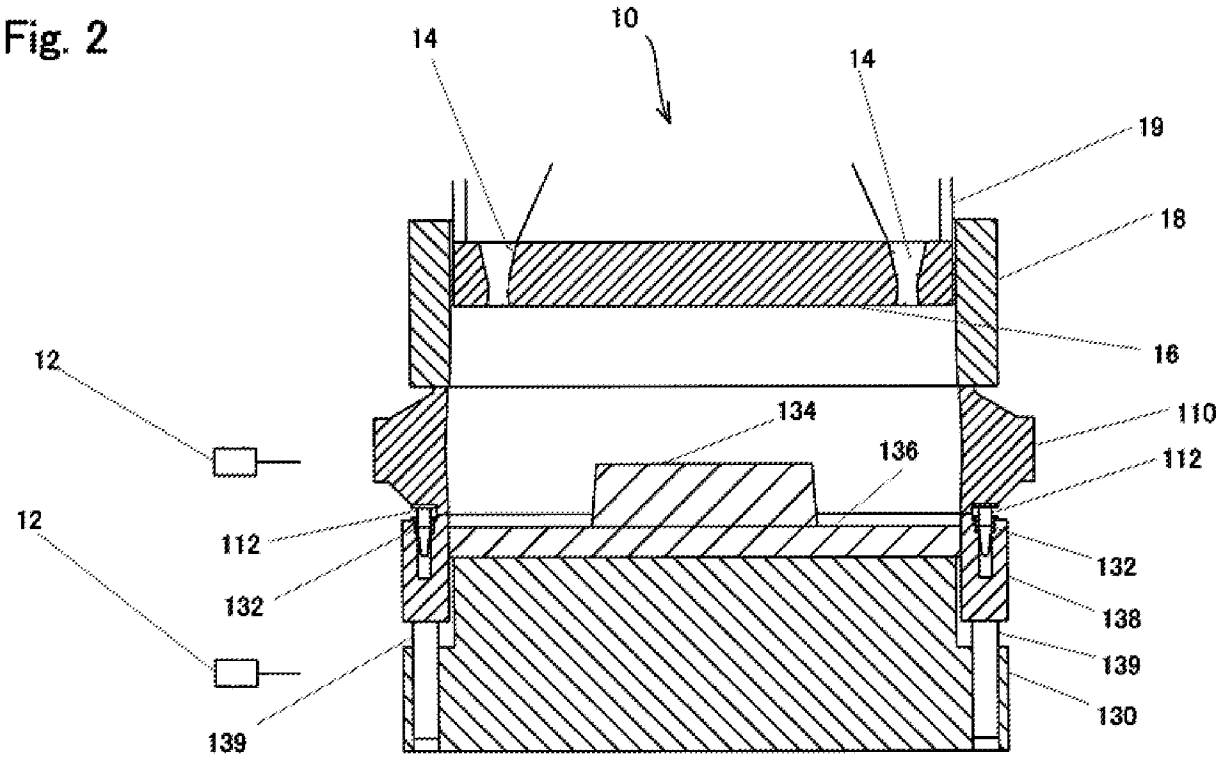
FIG. 2 is a partial and sectional side view illustrating the formation of a molding space in a cope flask by a molding machine.
Figure 3:
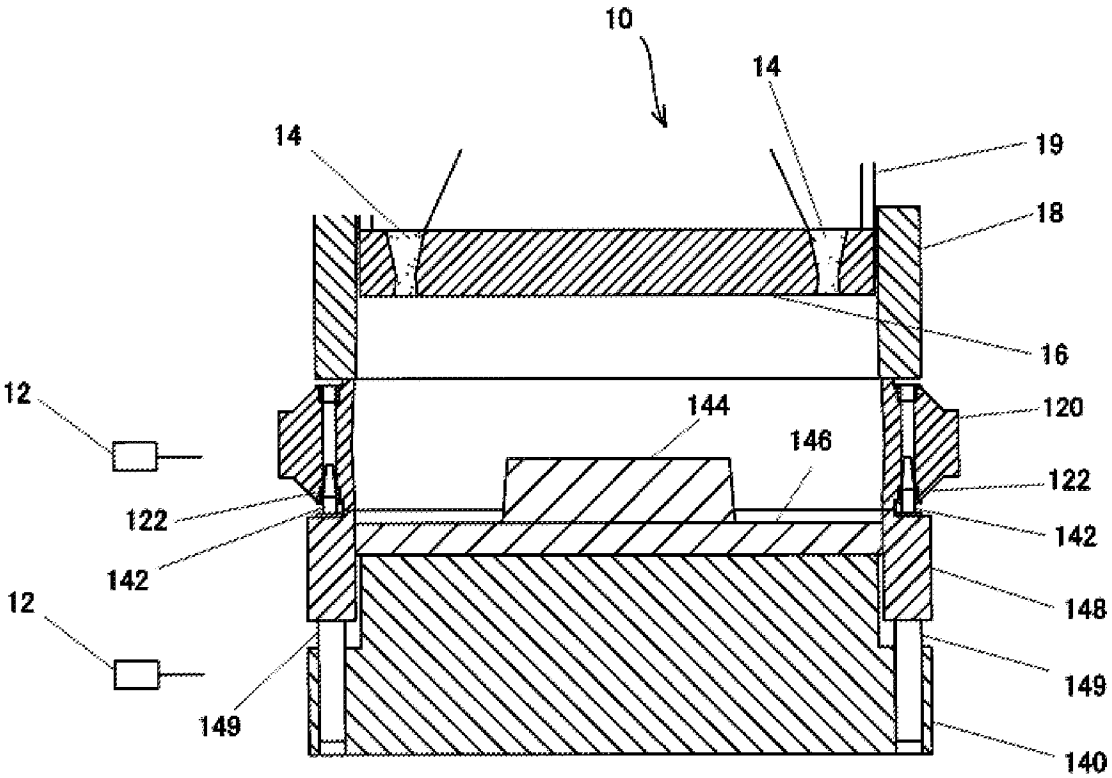
FIG. 3 is a partial and sectional side view illustrating the formation of a molding space in a drag flask by a molding machine.

Next, with reference to FIGS. 2 and 3, molding by the molding machine 10 is discussed. FIG. 2 is a partial and sectional view illustrating the formation of a molding space in the cope flask 110 by the molding machine 10. A pattern plate 136 for the cope flask to which a pattern 134 for the cope flask is fixed is fixed on the carrier plate 130 for the cope flask. The cope flask 110 is placed on it. In the present embodiment, the carrier plate 130 for the cope flask has a leveling frame 138 for the cope flask that is a frame that surrounds, and vertically slides on, the pattern plate 136. A plurality of guide pins 139 are connected to the lower part of the leveling frame 138 for the cope flask. They are vertically and slidably inserted in the main body of the carrier plate 130 for the cope flask. The leveling frame 138 for the cope flask is vertically moved by a vertical cylinder, which is not shown, via the guide pins 139. A bushing 132 of the carrier plate for the cope flask, which is the female jig for the positioning of the carrier plate 130 for the cope flask, is attached to the leveling frame 138 for the cope flask. By inserting a pin 112 for the cope flask, which is the male jig for the positioning of the cope flask 110, into the bushing 132 of the carrier plate for the cope flask, a shift between the carrier plate 130 for the cope flask and the cope flask 110 is prevented. However, after they are repeatedly used, the pin 112 for the cope flask or the bushing 132 of the carrier plate for the cope flask may be worn out, to cause a shift.

Typically, the bushing 132 of the carrier plate for the cope flask is a hole having a circular section and the pin 112 for the cope flask is a shaft having a circular section, the diameter of which decreases toward the tip. When the pin 112 for the cope flask is inserted into the bushing 132 of the carrier plate for the cope flask, a part of the pin 112 for the cope flask is preferably engaged with the bushing 132 of the carrier plate for the cope flask so that no rattle occurs. However, the shapes of the bushing 132 of the carrier plate for the cope flask and the pin 112 for the cope flask are not necessarily those mentioned above. They may have an arbitrary section, such as an elliptical, rectangular, or polygonal shape if the pin 112 for the cope flask can be inserted into the bushing 132, and engages with, the bushing 132 of the carrier plate for the cope flask, so that no rattle occurs. The bushing 132 of the carrier plate for the cope flask may be attached to a part that projects from the carrier plate 130 for the cope flask. Incidentally, the shape of the bushing 132 of the carrier plate for the cope flask and the shape of the pin 112 for the cope flask that are above discussed can be applied to the other female jig for the positioning (the bushing) and the other male jig for the positioning (the pin).

An auxiliary flask 18 is placed on the cope flask 110. A squeeze board 16 is inserted inside the auxiliary flask 18. A nozzle 14 for filling the molding sand is formed in the squeeze board 16 so that molding sand (not shown) in a hopper 19 for filling the molding sand that is located above the squeeze board 16 is supplied to the molding space in the cope flask 110. After the molding sand has been supplied to the molding space in the cope flask 110, the squeeze board 16 is lowered to squeeze the molding sand between it and the pattern plate 136 for the cope flask, to form a mold. A part that corresponds to the pattern 134 for the cope flask becomes a void space. That is, a space (the cavity part of the cope) is formed that will be a part of a product when the cope flask 110 and the drag flask 120 are assembled. By pouring molten metal into that space, a cast is manufactured. Incidentally, by lowering the leveling frame 138 for the cope flask during the squeezing, the molding sand is advantageously squeezed from the side of the pattern plate 136 for the cope flask.

FIG. 3 is a partial and sectional view illustrating the formation of a molding space in the drag flask 120 by the molding machine 10. The pattern plate 146 for the drag flask to which the pattern 144 for the drag flask is fixed is fixed on the carrier plate 140 for the drag flask. The drag flask 120 is placed on it. Like the carrier plate 130 for the cope flask, the carrier plate 140 for the drag flask has the leveling frame 148 for the drag flask. A plurality of guide pins 149 are attached to it that move so that the leveling frame 148 is vertically moved. The pin 142 of the carrier plate for the drag flask, which is the male jig for the positioning of the carrier plate 140 for the drag flask, is fixed to the leveling frame 148 for the drag flask. By inserting the pin 142 of the carrier plate for the drag flask in the bushing 122 for the drag flask, which is the female jig for the positioning of the drag flask 120, a shift between the carrier plate 140 for the drag flask and the drag flask 120 is prevented. However, a shift may occur as discussed above.

The auxiliary flask 18 is placed on the drag flask 120. The squeeze board 16 is inserted inside the auxiliary flask 18. The nozzle 14 for filling the molding sand is formed in the squeeze board 16 so that molding sand (not shown) in a hopper 19 for filling the molding sand that is located above the squeeze board 16 is supplied to the molding space in the drag flask 120. After the molding sand has been supplied to the molding space in the drag flask 120, the squeeze board 16 is lowered to squeeze the molding sand between it and the pattern plate 146 for the drag flask, to form a mold. The part that corresponds to the pattern 144 for the drag flask becomes a void space. That is, a space (the cavity part of the cope) is formed that will be a part of a product when the cope flask 110 and the drag flask 120 are assembled. By pouring molten metal into that space, a cast is manufactured. Incidentally, by lowering the leveling frame 148 for the drag flask during the squeezing, the molding sand is advantageously squeezed from the side of the pattern plate 146 for the drag flask. The molding machine 10 alternately molds a cope and a drag.

A sensor 12 is provided to the molding machine 10, to measure a shift between the carrier plate 130 for the cope flask and the cope flask 110 or between the carrier plate 140 for the drag flask and the drag flask 120. The sensor 12 may be a publicly-known displacement sensor, such as a laser displacement sensor, an infrared displacement sensor, or a contact displacement sensor. Since measuring the position of the pattern is difficult, the positions of the carrier plate and the flask are measured, to estimate a shift between the pattern and the flask. The shift between the carrier plate 130 for the cope flask and the cope flask 110 or between the carrier plate 140 for the drag flask and the drag flask 120 is normally measured before molding. However, it may also be measured after the squeezing. A shift between the carrier plate and the flask may occur during the squeezing. By measuring the shift before and after the squeezing, the bushing 132 and the pin 142 for the carrier plates for the cope and drag flasks or the pin 112 and the bushing 122 for the cope and drag flasks, or both, may be found to be worn out.

Figure 4:
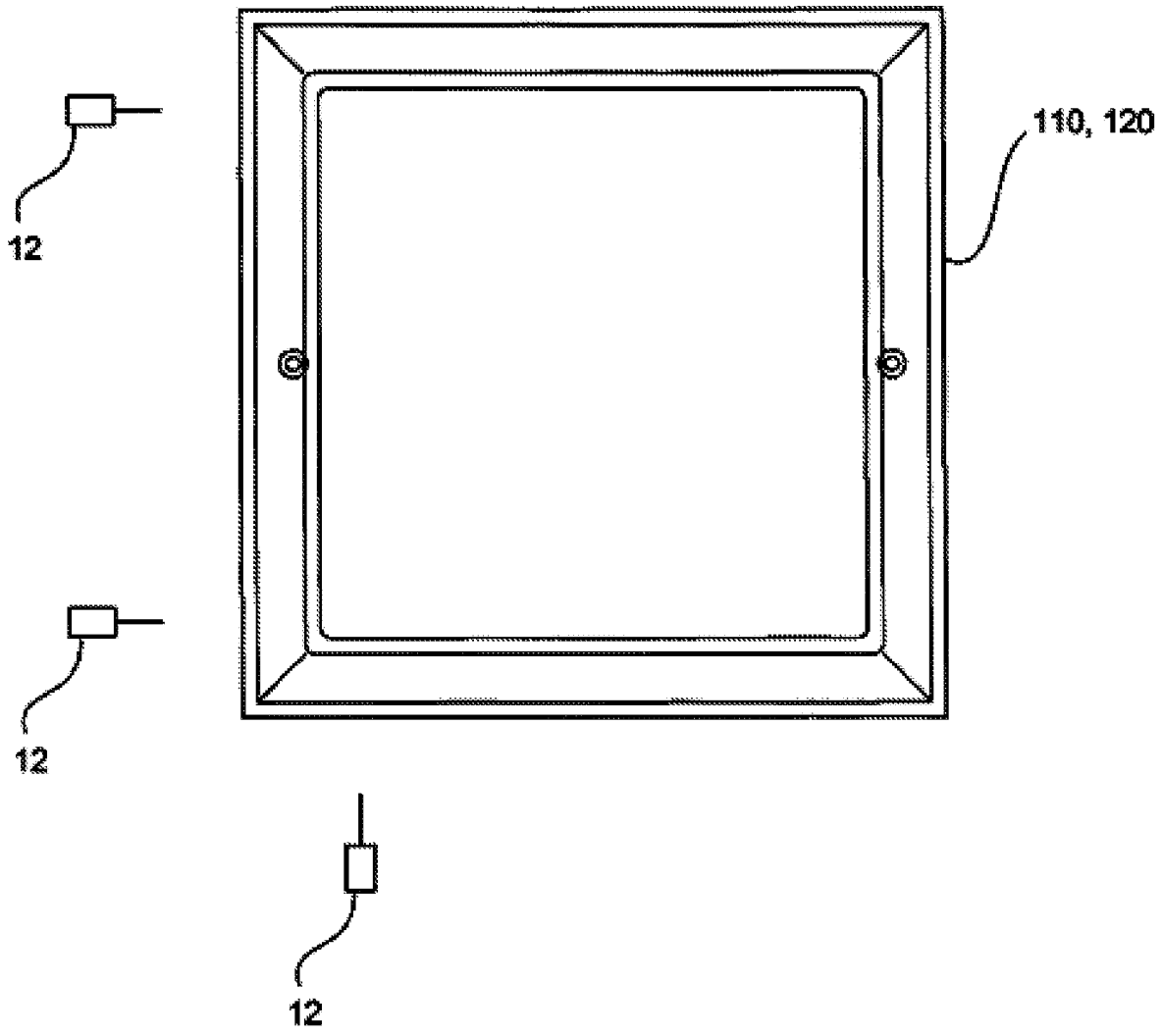
FIG. 4 is a partial plan view illustrating the measurement of a shift between the carrier plate and the flask in the molding machine.

As in the plan view of FIG. 4, three sensors 12 for the flask are provided. In the same way, three sensors 12 for the carrier plate are provided. Incidentally, the three sensors may be vertically moved to measure the positions of both the flask and the carrier plate. Since three sensors 12 are provided, three respective distances to the flask or the carrier plate can be measured. Since the coordinates of the three sensors 12 are known, the coordinates of the three points of the flask and those of the carrier plate can be found. When the coordinates of the three points are found, the positions of the centers and the angles of rotations in the horizontal plane of the flask and the carrier plate can be calculated, since the shapes of them are known. The shift between the flask and the carrier plate can be determined based on the shifts between the positions of the centers and the angles of rotation in the horizontal plane that have been calculated or based on the coordinates of the corners of the flask and the carrier plate that have been calculated based on the positions of the centers and the angles of rotation. Since the shapes of the flask and the carrier plate are known, the shift between the flask and the carrier plate can be accurately found.

A shift between the flask and the carrier plate is prevented by inserting the pin 112 for the cope flask into the bushing 132 of the carrier plate for the cope flask and by inserting the pin 142 of the carrier plate for the drag flask into the bushing 122 for the drag flask. However, the pin 112 for the cope flask, the bushing 132 of the carrier plate for the cope flask, the pin 142 of the carrier plate for the drag flask, or the bushing 122 for the drag flask, may be worn out after being repeatedly used, so that a shift occurs.

Figure 5:
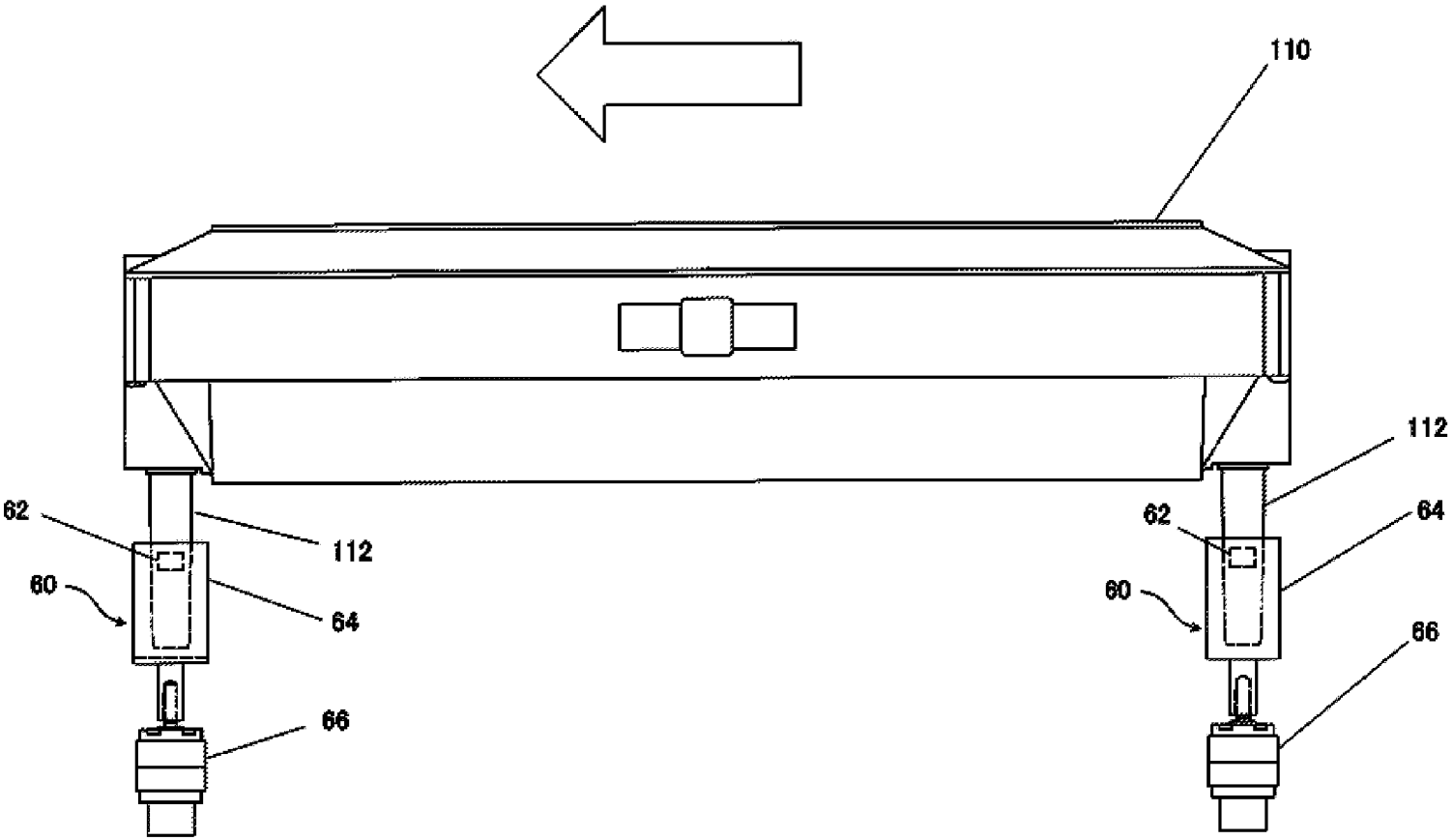
FIG. 5 is a side view illustrating the measurement of the degree of wear of the pin (the male jig for the positioning) of the cope flask.
Figure 6:
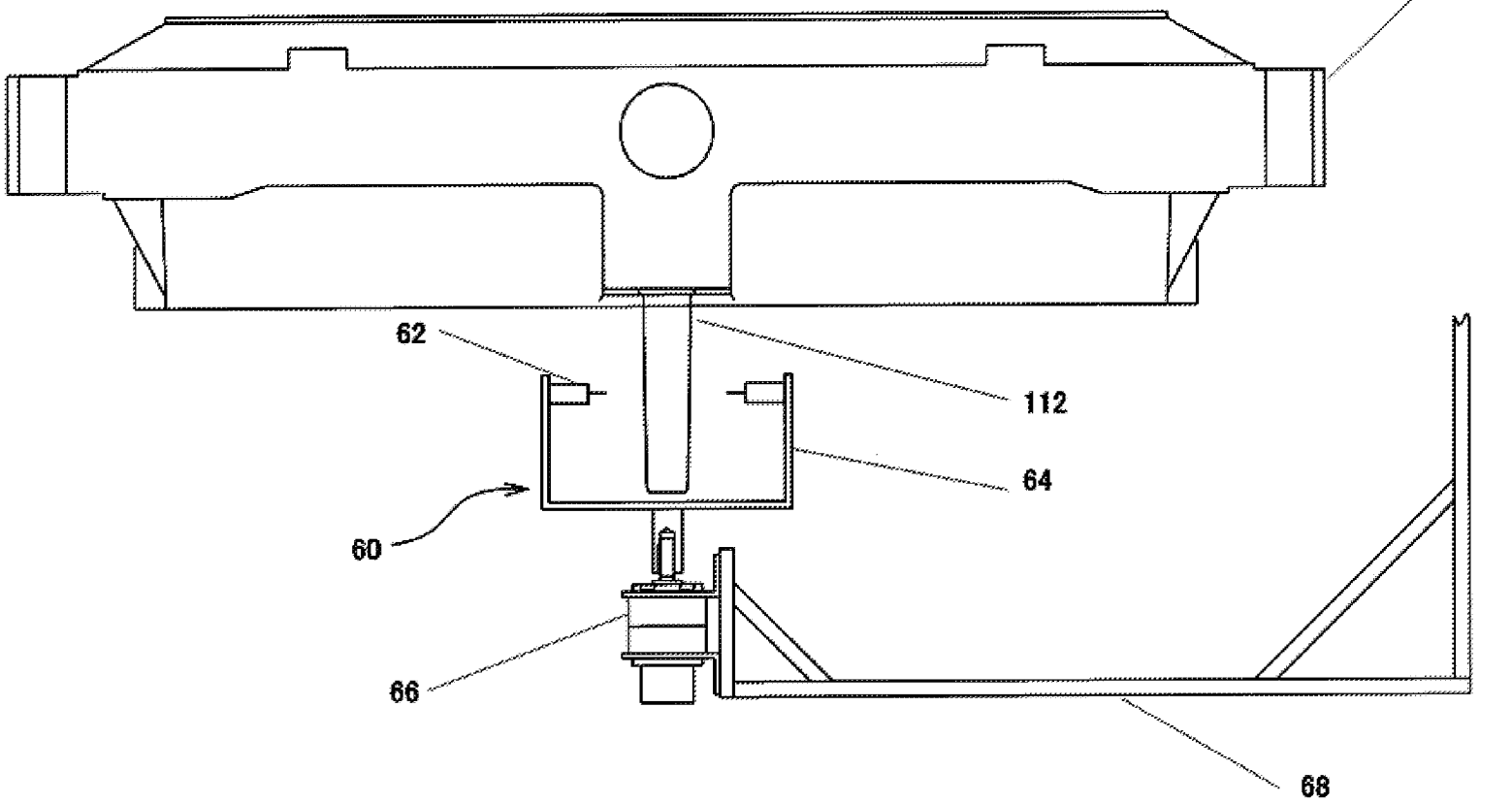
FIG. 6 is a side view illustrating the measurement of the degree of wear of the pin (the male jig for the positioning) of the cope flask. It is shown in a direction that is perpendicular to that in FIG. 5.

Therefore, the degree of the wear of the pin and the bushing is measured. FIGS. 5 and 6 are side views illustrating the measurement of the degree of wear of the pin 112 for the cope flask by means of a device 60 for measuring the degree of wear of the pin. Since two pins 112 for the cope flask are normally provided to the cope flask 110, the degrees of wear of the two pins 112 for the cope flask are measured by two respective pdevices 60 for measuring the degrees of wear of the pins. However, the number of pins is not limited to two and the number of devices 60 for measuring the degrees of wear of the pins is not limited to two. In the device 60 for measuring the degrees of wear of the pins, the pin 112 for the cope flask is positioned, for example, in a holder 64 for the sensor that has an open top. The pin 112 for the cope flask is preferably positioned concentrically with the holder 64 for the sensor. The sensor 62 that measures the coordinates of the surface of the pin 112 for the cope flask is located at a set height of the holder 64 for the sensor. The set height is a height to measure a part of the pin 112 for the cope flask that engages with the bushing 132 of the carrier plate for the cope flask or the bushing 122 for the drag flask. In FIG. 6 the holder 64 for the sensor has two sensors 62. However, the number of sensors 62 may be just one or three or more. The sensor 62 may be a publicly-known displacement sensor, such as a laser displacement sensor, an infrared displacement sensor, or a contact displacement sensor. The holder 64 for the sensor is held by a rotary actuator 66 to be rotated about the pin 112 for the cope flask. The rotary actuator 66 is fixed by a holder 68 for the device for the measurement.

By the device 60 for measuring the degree of wear of the pin, the coordinates of the entire circumference of the pin 112 for the cope flask can be measured by means of the sensor 62, since the holder 64 for the sensor is rotated about the pin 112 for the cope flask. That is, the degree of wear of the entire circumference of the pin 112 for the cope flask can be measured. For example, the maximum degree of wear is assumed to be the degree of wear of the pin 112 for the cope flask. Alternatively, the average of the measured degrees of wear or the degree of wear at an arbitrary position may be used. The measured degrees of wear are preferably stored with a link to the cope flask 110.

Figure 7:
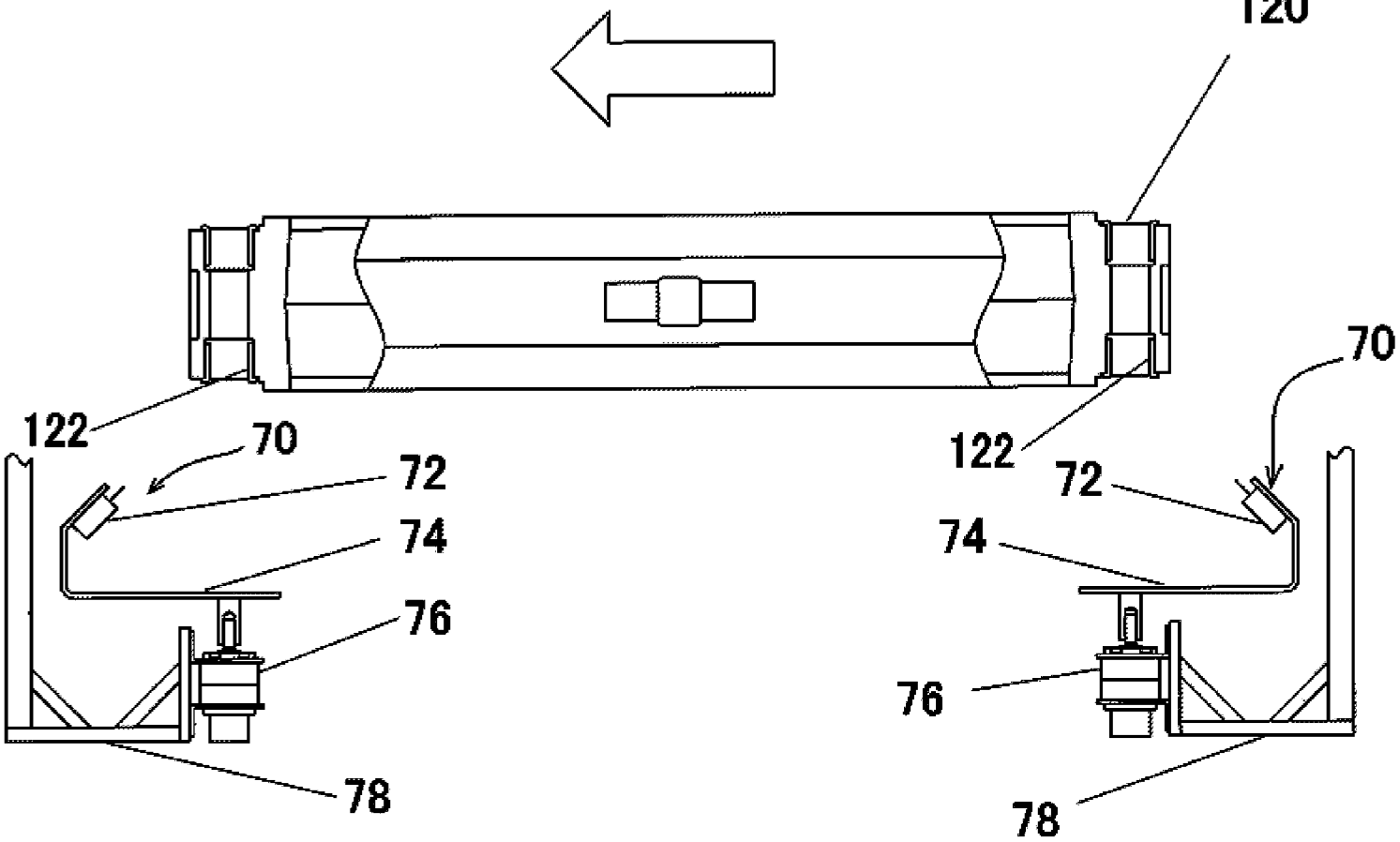
FIG. 7 is a side view illustrating the measurement of the degree of wear of the bushing (the female jig for the positioning) of the drag flask.
Figure 8:
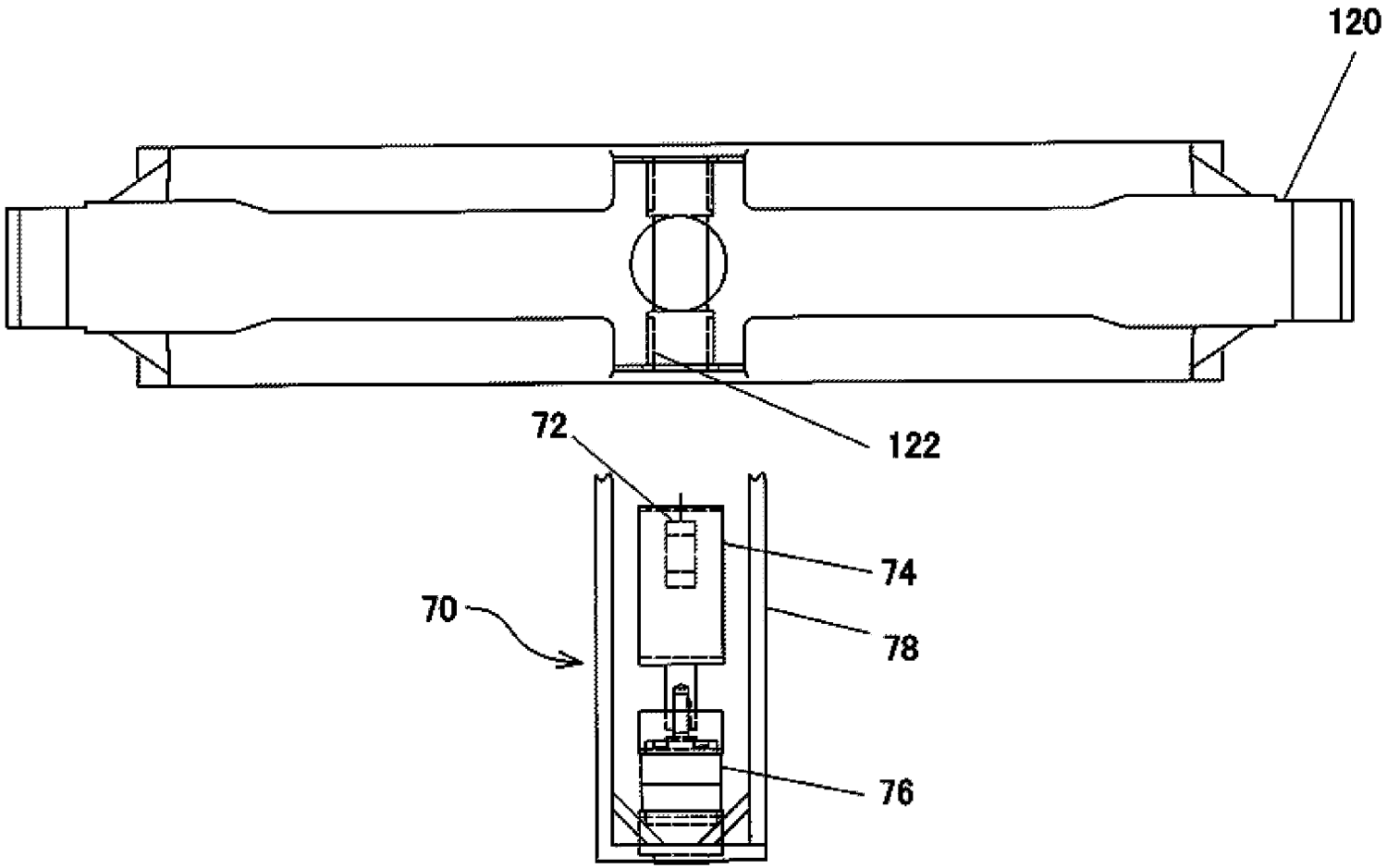
FIG. 8 is a side view illustrating the measurement of the degree of wear of the bushing (the female jig for the positioning) of the drag flask. It is shown in a direction that is perpendicular to that in FIG. 7.

FIGS. 7 and 8 are side views illustrating the measurement of the degree of wear of the bushing 122 for the drag flask of the drag flask 120 by means of a device 70 for measuring the degree of wear of the bushing. Two bushings 122 for the drag flask are provided in conformity with two pins 112 for the cope flask. Also, two devices 70 for measuring the degree of wear of the bushing are provided. However, the number of bushings is not limited to two and the number of devices 70 for measuring the degree of wear of the bushing is also not limited to two. In the device 70 for measuring the degree of wear of the bushing, a sensor 72 that is directed to measure the inner surface of the bushing 122 for the drag flask is supported by a holder 74 for the sensor. The sensor 72 may be a publicly-known displacement sensor, such as a laser displacement sensor, an infrared displacement sensor, or a contact displacement sensor. By using a displacement sensor, the sensor 72 that is located obliquely below the bushing 122 for the drag flask can measure the inner surface of the bushing 122 for the drag flask that is located obliquely above it. The holder 74 for the sensor is held by the rotary actuator 76 to be rotated about the bushing 122 for the drag flask. The rotary actuator 76 is fixed directly below the bushing 122 for the drag flask by means of a holder 78 for the device for the measurement.

By the device 70 for measuring the degree of wear of the bushing, the coordinates of the entire inner circumference of the bushing 122 for the drag flask can be measured by means of the sensor 72, since the holder 74 for the sensor is rotated about the bushing 122 for the drag flask. That is, the degree of wear of the entire inner circumference of the bushing 122 for the drag flask can be measured. For example, the maximum degree of wear is assumed to be the degree of wear of the bushing 122 for the drag flask. Alternatively, the average of the measured degrees of wear or the degree of wear at an arbitrary position may be used. The measured degrees of wear are preferably stored with a link to the drag flask 120.

The degrees of wear of the pin 112 for the cope flask and the bushing 122 for the drag flask are preferably measured at the positions P1 and P2 of the flask as in FIG. 1. That is, the device 60 for measuring the degree of wear of the pin and the device 70 for measuring the degree of wear of the bushing are preferably located upstream of the molding machine 10.

About the carrier plate 140 for the drag flask, the degree of wear of the pin 142 of the carrier plate for the drag flask is measured in the same way as that discussed about the pin 112 for the cope flask with reference to FIGS. 5 and 6. About the carrier plate 130 for the cope flask, the degree of wear of the bushing 132 of the carrier plate for the cope flask is measured in the same way as that discussed about the bushing 122 for the drag flask with reference to FIGS. 7 and 8. The degrees of wear of the pin 142 of the carrier plate for the drag flask and the bushing 132 of the carrier plate for the cope flask are preferably measured outside the flow of the molds in FIG. 1 (outside the molding machine 10), i.e., before the carrier plate 130 for the cope flask and the carrier plate 140 for the drag flask are carried in the molding machine 10. The measured degrees of wear are preferably stored with a link to the carrier plate 140 for the drag flask or the carrier plate 130 for the cope flask.

Figure 9:
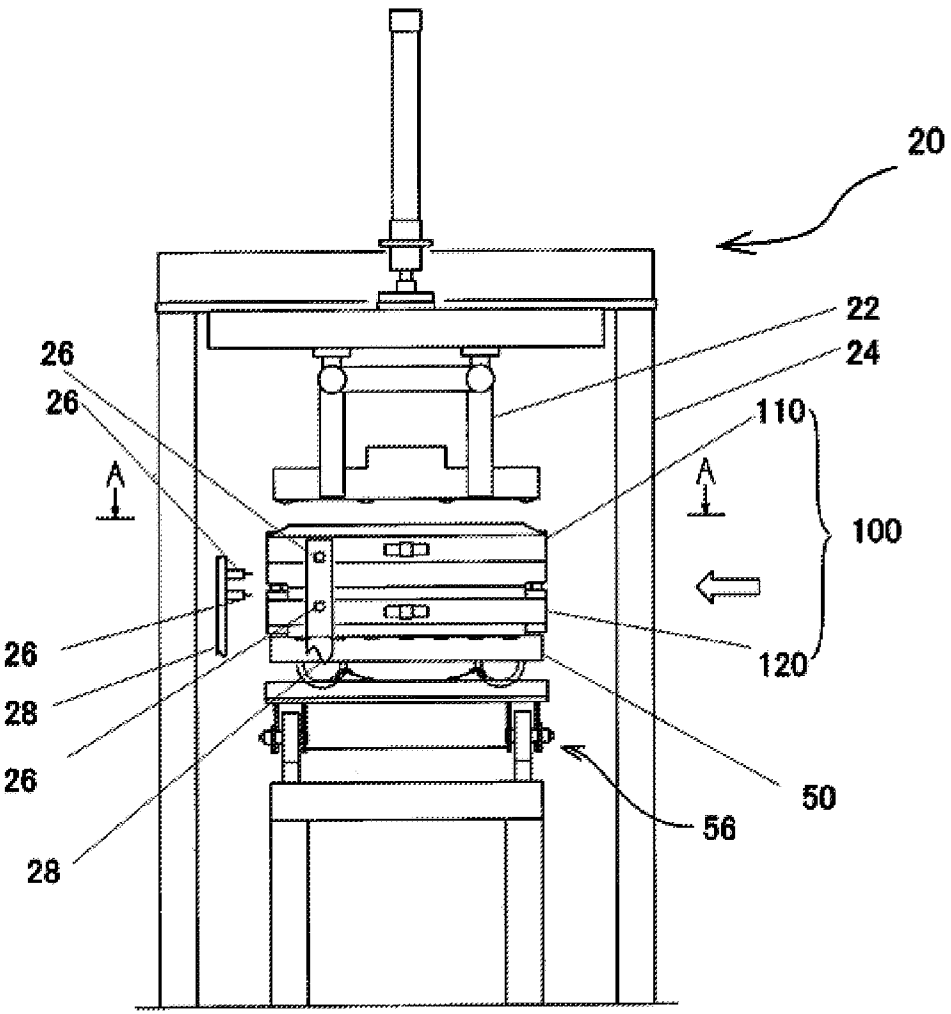
FIG. 9 is a side view illustrating the mold assembling of the cope and drag flasks and the measurement of a shift between the cope flask and the drag flask by a mold-assembling device.
Figure 10:
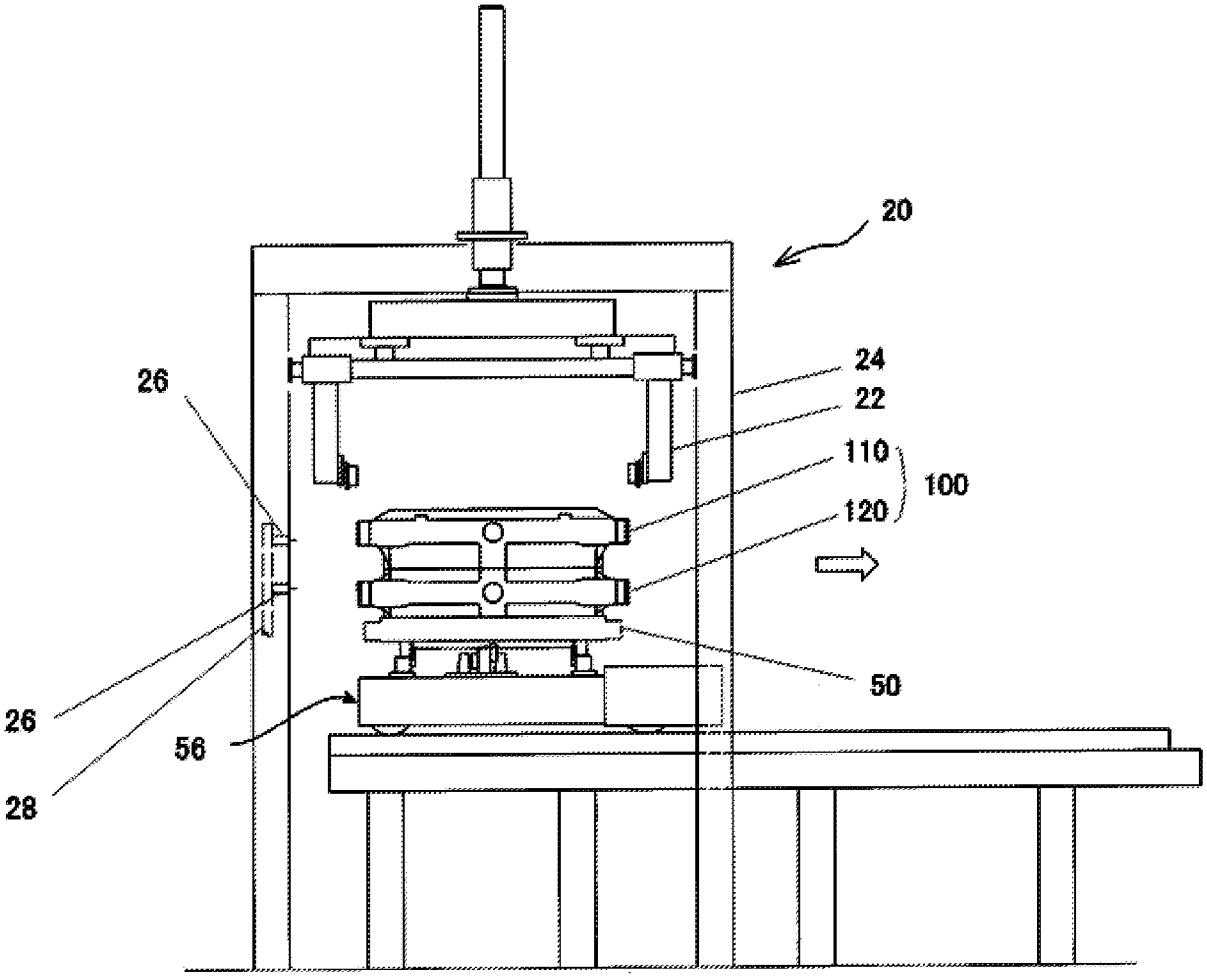
FIG. 10 is a side view illustrating the mold assembling of the cope and drag flasks and the measurement of a shift between the cope flask and the drag flask by a mold-assembling device. It is shown in a direction that is perpendicular to that in FIG. 9.

FIGS. 9 and 10 illustrate the mold assembling of the cope and drag flasks by the mold-assembling device 20. The cope flask and the drag flask that have alternately been molded by the molding machine 10 are treated by means of the roll-over machine 82, the sand cutter 84, the sprue-forming machine 86, and the machine 88 for re-rolling over the cope flask. Then they are assembled by means of the mold-assembling device 20. The mold-assembling device 20 mounts the drag flask 120 on the carriage 50 with a molding board that is placed on the traversers 56 by means of a lifter 22. The drag flask 120 houses the drag in which the cavity part faces upwardly. Next, the cope flask 110 is placed on the drag flask 120 by means of the lifter 22. The drag flask 120 houses the cope in which the cavity part has been caused by the machine 88 for re-rolling over the cope flask to face downwardly. A shift between the cope flask 110 and the drag flask 120 is prevented by inserting the pin 112 for the cope flask, which is the male jig for the positioning of the cope flask 110, into the bushing 122 for the drag flask, which is the female jig for the positioning of the drag flask 120. However, the pin 112 for the cope flask or the bushing 122 for the drag flask may be worn out after being repeatedly used, so that a shift occurs.

Therefore, sensors 26 are provided to the mold-assembling device 20, to measure a shift between the cope flask 110 and the drag flask 120. The sensor 26 may be any publicly-known displacement sensor, such as a laser displacement sensor, an infrared displacement sensor, or a contact displacement sensor. The sensors 26 are held by the holder 28 for the sensor at two stages, i.e., at the up stage and at the down stage. The holder 28 for the sensor is supported by a rack 24. However, the sensors 26 on either stage may measure both the cope flask 110 and the drag flask 120 by being vertically moved. In this case, the holder 28 for the sensor may be configured to vertically move in relation to the rack 24.

Figure 11:
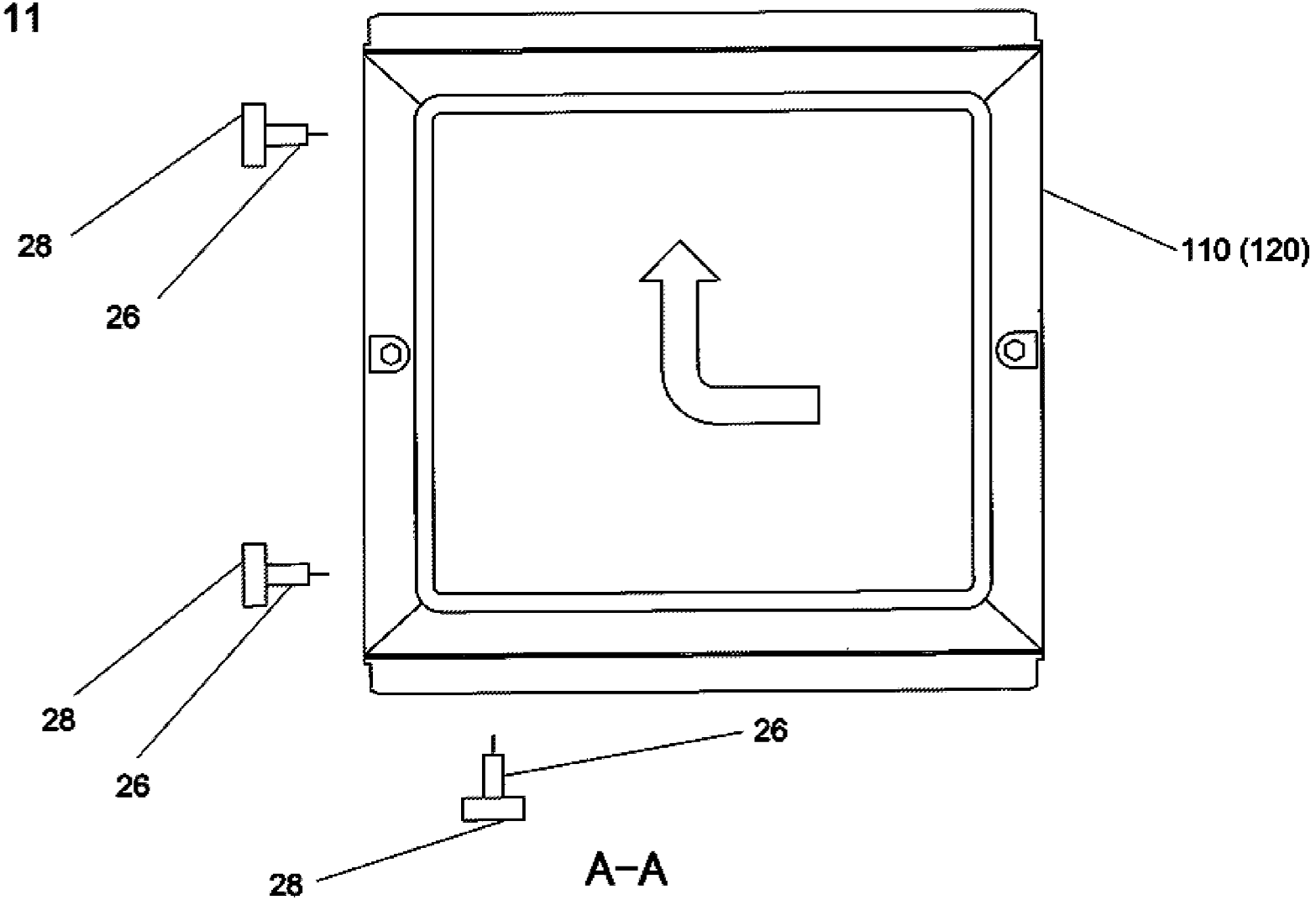
FIG. 11 is a plan view illustrating the mold assembling of the cope and drag flasks and the measurement of a shift between the cope flask and the drag flask by a mold-assembling device. It is viewed along the arrows A-A in FIG. 9.

As in FIG. 11, three sensors 26 are provided for the cope flask 110. In the same way, three sensors 26 are provided for the drag flask 120. Incidentally, both the cope flask 110 and the drag flask 120 are measured by three sensors that are vertically moved. Since three sensors 26 are provided, the distances to three points of the cope flask 110 or the drag flask 120 can be measured. Since the coordinates of the three sensors 26 are known, the coordinates of the three points of the cope flask 110 and those of the drag flask 120 can be found. When the coordinates of the three points are found, the positions of the centers and the angles of rotations in the horizontal plane of the cope flask 110 and the drag flask 120 can be calculated, since their shapes are known. The shift between the cope flask 110 and the drag flask 120 can be determined based on the shifts between the positions of the centers and the angles of rotation in the horizontal plane that have been calculated or based on the coordinates of the corners of the cope flask 110 and the drag flask 120 that have been calculated based on the positions of the centers and the angles of rotation. Since the shapes of the cope flask 110 and the drag flask 120 are known, the shift between them can be accurately found.

Figure 12A:
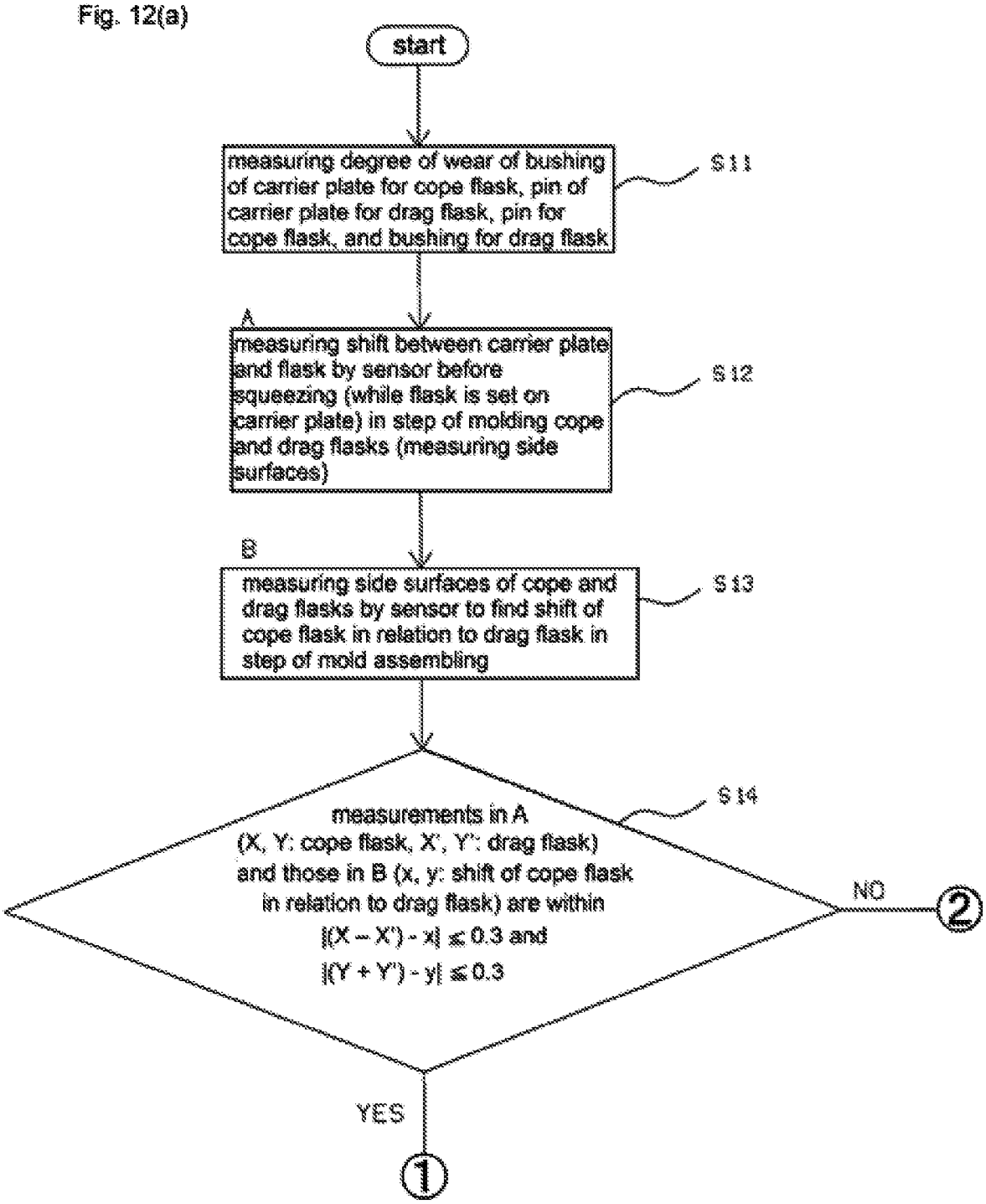
FIG. 12 is a flowchart of the method for preventing a defect caused by a mold shift. The flowchart is divided into three drawings, (a), (b), and (c).
Figure 12B:
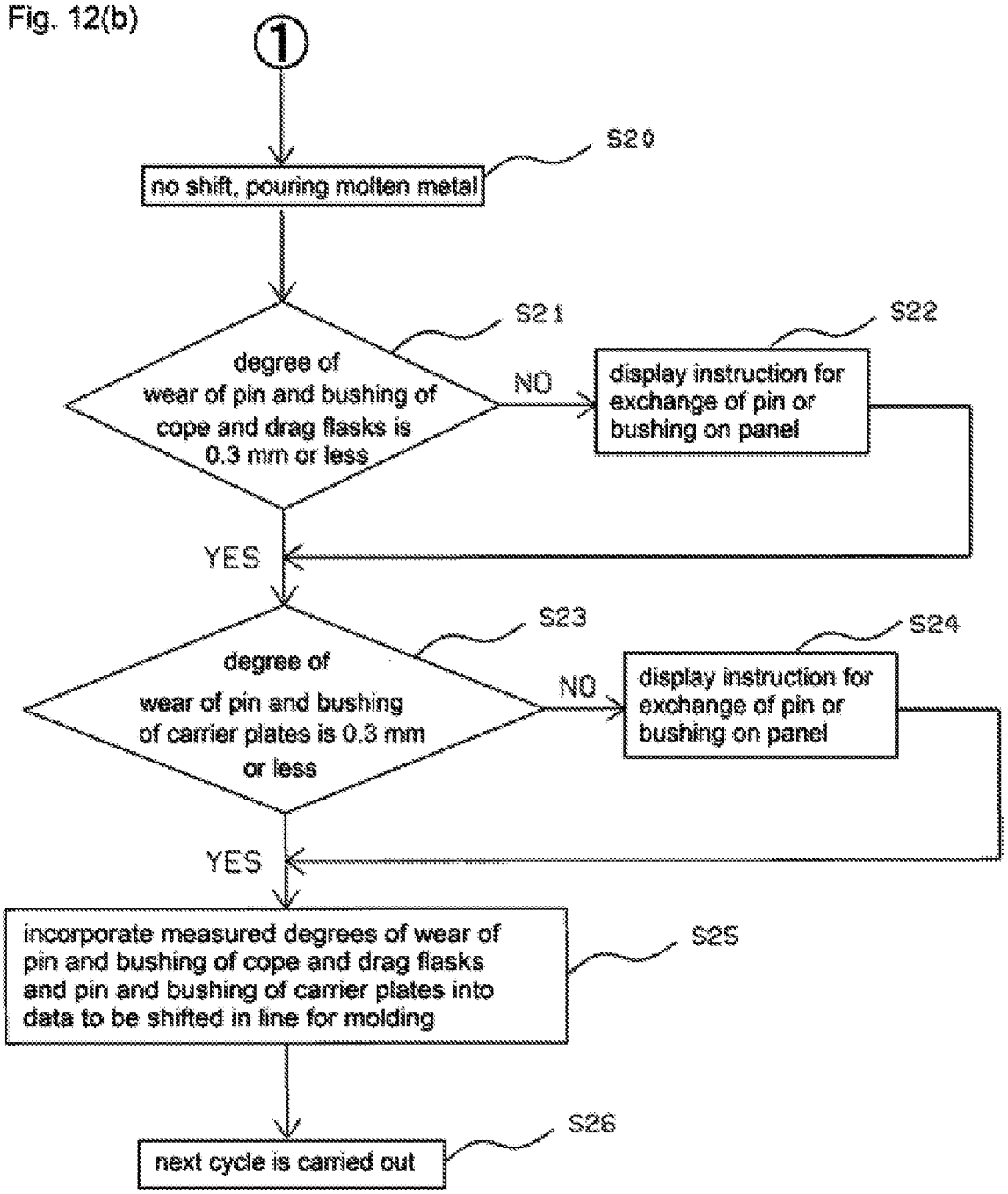
Figure 12C:
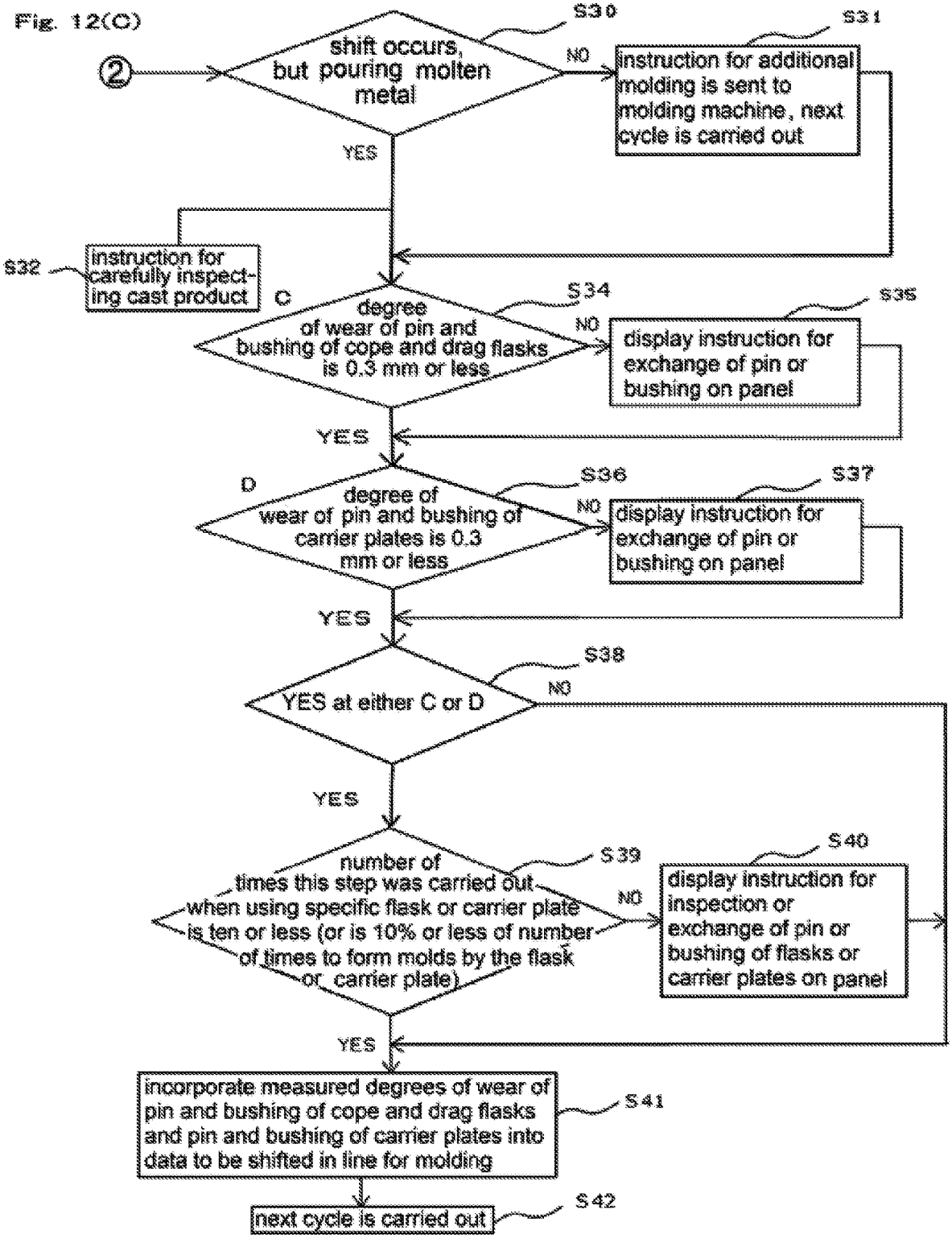

Next, with reference to the flowchart in FIG. 12, estimating the shift in cavity parts and preventing a defect caused by the shift are discussed. Incidentally, the flowchart is divided into 3 sheets, (a)-(c). The connecting points are shown by using the encircled numbers. First, as discussed with reference to FIGS. 5-8, the degrees of wear of the pin 112 for the cope flask, the bushing 122 for the drag flask, the bushing 132 of the carrier plate for the cope flask, and the pin 142 of the carrier plate for the drag flask, are measured (S11). The data on the degrees of wear that have been measured are stored with links to the cope flask 110, the drag flask 120, the carrier plate 130 for the cope flask, and the carrier plate 140 for the drag flask. For example, they are stored in a controller (not shown) for the line for the molding.

Next, as discussed with reference to FIGS. 2-4, the shifts X, Y (X and Y are shifts in two horizontal directions that are perpendicular to each other) between the cope flask 110 and the carrier plate 130 for the cope flask and the shifts X', Y' (X' and Y' are shifts in two horizontal directions that are perpendicular to each other) between the drag flask 120 and the carrier plate 140 for the drag flask are measured by the molding machine 10 (S12). Next, as discussed with reference to FIGS. 9-11, the shifts x, y (x and x are shifts in two horizontal directions that are perpendicular to each other) between the cope flask 110 and the drag flask 120 that have been assembled are measured by means of the mold-assembling device 20, where the shifts are measured as shifts of the cope flask 110 in relation to the lower flask 120 (S13). Incidentally, the shifts X, Y, X', Y', x, y may be shifts of the coordinates of the corners, that is, the maximum values or average values of the shifts of the coordinates of four corners, or shifts of an arbitrary corner among four corners.

Next, it is determined if the shifts are within the allowable range (S14). Thus it is determined if the relationships $|(X-X')-x|\leq 0.3$, $|(Y+Y')-y|\leq 0.3$ are fulfilled. The value "0.3" at the right hand denotes the allowable value, 0.3 mm. However, the allowable value is not limited to 0.3 mm, since it is determined based on a shape, a size, an application, etc., of a cast. The "(X−X')" calculates the difference between the shift X, which is the shift between the cope flask 110 and the carrier plate 130 for the cope flask, and the shift X', which is the shift between the drag flask 120 and the carrier plate 140 for the drag flask. If the direction of the shift of the cope flask 110 in relation to the carrier plate 130 for the cope flask (i.e., the cavity part for the cope flask) is the same as that of the drag flask 120 in relation to the carrier plate 140 for the drag flask (i.e., the cavity part for the drag flask), then the shifts in the cavity parts are canceled out when the cope and drag flasks are assembled. Thus, the difference between the shift X and the shift X' is assumed to be the shift in cavity parts. By the present embodiment, since the drag flask 120 is not subject to re-rolling over, the direction of X' (a direction of a shift between the cope flask 110 and the drag flask 120 in a direction to transport the flasks) is not changed. About the direction of Y' (the direction of the shift between the cope flask 110 and the drag flask 120 in a direction that is perpendicular to the direction to transport the flasks), since the direction of the shift of the cope flask 110 is reverse to that of the drag flask 120, the sum of the shift Y between the cope flask 110 and the pattern 134 for the cope flask and the shift Y' between the drag flask 120 and the pattern 144 for the drag flask is used. In both calculations, the shifts between the patterns 134, 144 for the cope and drag flasks and the cope and drag flasks 110, 120 are found. By using the formulae $|(X-X')-x|$, $|(Y+Y')-y|$ the absolute values of the shifts in cavity parts are calculated by reducing the shifts x, y between the cope flask 110 and the drag flask 120 from the shifts between the patterns 134, 144 for the cope and drag flasks and the cope and drag flasks 110, 120. It is determined if those shifts are within the allowable value, 0.3 mm.

By this configuration, the results of measurements of the shifts between the cope and drag flasks 110, 120 and the patterns 134, 144 for the cope and drag flasks and the results of measurements of the shifts between the cope flask 110 and the drag flask 120 are combined to find the shifts in cavity parts, to determine if a defect that is caused by the shift occurred. That is, the reliability in determining an occurrence of a defect increases compared to where the shift is determined based only on a shift between the cope flask 110 and the drag flask 120 that have been assembled. Thus determining to be a defect even when no defective product will be manufactured can be prevented, so that the waste of many molds is prevented.

Next, with reference to FIG. 12(*b*), the operations that are carried out when the above operations determine that no shift has occurred are discussed. Since no shift occurs, molten metal is poured into the mold as usual (S20). It is determined if the degrees of wear of the pin 112 of the cope flask 110 and the bushing 122 of the drag flask 120 are within the allowable range (0.3 mm or less) (S21). Even if no shift between the cope and drag flasks 110, 120 occurs, an instruction for the exchange is displayed on a panel, etc., if the degree of wear of the pin 112 or the bushing 122 exceeds the allowable range (S22). Next, it is determined if the degrees of wear of the bushing 132 of the carrier plate 130 and the pin 142 of the carrier plate 140 are within the allowable range (0.3 mm or less) (S23). Even if no shift between the cope and drag flasks 110, 120 occurs, an instruction for the exchange is displayed on a panel, etc., if the degree of wear of the bushing 132 or the pin 142 exceeds the allowable range (S24).

The degree of wear of the pin 112 of the cope flask 110 is stored with a link to the cope flask 110 (as data to be shifted of the cope flask 110). The degree of wear of the bushing 122 of the drag flask 120 is stored with a link to the drag flask 120 (as data to be shifted of the drag flask 120). The degree of wear of the bushing 132 of the carrier plate 130 for the cope flask is stored with a link to the carrier plate 130 for the cope flask (as data to be shifted of the carrier plate 130 for the cope flask). The degree of wear of the pin 142 of the carrier plate 140 for the drag flask is stored with a link to the carrier plate 140 for the drag flask (as data to be shifted of the carrier plate 140 for the drag flask) (S25). The term "data to be shifted" means data that include data on the cope flask, the drag flask, the carrier plate for the cope flask, or the carrier plate for the drag flask, and are shifted in conformity with their movements. That is, they are the data that are linked with the cope flask, the drag flask, the carrier plate for the cope flask, or the carrier plate for the drag flask. In this way the data on the degrees of wear are managed for each of the cope flask, the drag flask, the carrier plate for the cope flask, and the carrier plate for the drag flask, so that a part that has been worn out can quickly be exchanged during the maintenance of the line 1 for the molding. Thus an inspection and an exchange can effectively be carried out. Then, the next cycle, i.e., a next molding, is carried out (S26).

Next, with reference to FIG. 12(*c*), the operations that are carried out when the above operations determine that a shift has occurred are discussed. First, though the shift in the cavity parts has occurred, it is determined if molten metal should be poured (S30). There is a case where molten metal is poured into a mold where a shift has occurred. In this case an instruction for carefully inspecting a cast product is generated (S32), to carefully inspect a cast product to find a problem in using it. If no molten metal is poured, then one mold is short. Thus an instruction for additional molding is sent to the molding machine 10 (S31).

It is determined if the degrees of wear of the pin 112 of the cope flask 110 and the bushing 122 of the drag flask 120 are within the allowable range (0.3 mm or less) (S34). If the degree of wear of the pin 112 or the bushing 122 exceeds the allowable range, an instruction for the exchange is displayed on a panel, etc. (S35). Next, it is determined if the degrees of wear of the bushing 132 of the carrier plate 130 and the pin 142 of the carrier plate 140 are within the allowable range (0.3 mm or less) (S36). If the degree of wear of the pin 142 or the bushing 132 exceeds the allowable range, an instruction for the exchange is displayed on a panel, etc. (S37).

Next, it is determined if either the degrees of wear of the pin 112 and the bushing 122 or those of the pin 142 and the bushing 132 are within the allowable range (determined as YES) (S38). If the degree of wear of the pin 112 or the bushing 122 and that of the pin 142 or the bushing 132 exceed the allowable range (determined as NO), the cause of the shift in cavity parts is estimated as wear of the pin or the bushing. The instructions for the exchange of the pin or the bushing has been displayed on the panel, etc., and so an operator has been alerted.

If either or both of the degrees of wear of the pin 112 and the bushing 122 and those of the pin 142 and the bushing 132 are within the allowable range (if YES at S38), a shift is considered to have occurred for a reason that is specific to that mold (for example, being unevenly worn out) or by accident. Thus, it is determined if such a phenomenon often occurs when using the same flask or the same carrier plate (S39). That is, the number of accumulated times this step was carried out when using a specific flask or carrier plate may be, for example, ten or less. If it is over ten (if NO at S39), a defect may exist in the pin or the bushing of the flask or the carrier plate. Thus an instruction for the inspection or the exchange of the pin or the bushing of the flask or the carrier plate is displayed on the panel, etc., (S40).

Incidentally, the number of continuous times, not accumulated times, may be used for determining if the phenomenon occurs when using a specific flask or carrier plate. Alternatively, the ratio of the number of times to carry out that step to the total number when using a specific flask or carrier plate may be used. For example, if the ratio exceeds 10%, an instruction for the inspection or the exchange of the pin or the bushing of the flask or the carrier plate is displayed on the panel, etc. Incidentally ten or 10% is just an example, and another number may be used.

Next, in the same way as discussed above, the results of the measurements of the degrees of wear of the pin and the bushing of the flasks and the carrier plates are stored as data to be shifted. By this, the flask or the carrier plate that has been inspected or exchanged during the maintenance can quickly be found, so that an inspection and an exchange can effectively be carried out (S41). Then, the next cycle, i.e., a next molding, is carried out (S42).

As discussed with reference to FIGS. 5-8, since the circumference of the pin 112 for the cope flask, of the bushing 122 for the drag flask, of the bushing 132 of the carrier plate for the cope flask, and of the pin 142 of the carrier plate for the drag flask, are measured, the shapes of the pin and the bushing are determined. Thus, for example, it can be judged if a large shift is determined to have occurred even when the pin or the bushing has not substantially been worn out. In such a case the device 60 for measuring the degree of wear of the pin or the device 70 for measuring the degree of wear of the bushing may not correctly work. Alternatively, a part for attaching the sensor 12, 26 that has measured the shift may be unusual. Thus, a step of comparing the respective shapes of the pin and the bushing with the measured shift is effective. Incidentally, by the above discussion, a shift between the flask and the carrier plate and between the cope and drag flasks is prevented by means of the pin and the bushing. However, the shift may be prevented by another known method (for example, by a convex bushing and a concave bushing).

By the method for estimating the shift in cavity parts and preventing a defect caused by the shift of the present invention, the shift in cavity parts is determined based on the shift between the flasks and the carrier patterns for the cope and drag flasks and the shift between the cope and drag flasks, to determine if a defect that is caused by the shift occurs. Thus, the reliability in determining an occurrence of a defect increases, to decrease the waste of molds. Further, since the data on the degrees of wear of the pins and bushings are managed as data to be shifted, a part that has been worn out can be quickly and efficiently exchanged, to efficiently operate the line for molding.

Below, the main reference numbers that are used in the specification and the drawings are listed.

1 the line for the molding
10 the molding machine
12 the sensor
14 the nozzle for filling the molding sand
16 the squeeze board
18 the auxiliary flask
19 the hopper for filling the molding sand
20 the mold-assembling device
22 the lifter
24 the rack
26 the sensor
28 the holder for the sensor
30 the pouring machine
40 the shake-out machine
42 the machine for separating the flask
50 the carriage with a molding board
52 the pusher
54 the cushion
56 the traverser
60 the device for measuring the degree of wear of the pin
62 the sensor
64 the holder for the sensor
66 the rotary actuator
68 the holder for the device for the measurement
70 the device for measuring the degree of wear of the bushing
72 the sensor
74 the holder for the sensor
76 the rotary actuator
78 the holder for the device for the measurement
82 the roll-over machine
84 the sand cutter
86 the sprue-forming machine
88 the machine for re-rolling over the cope flask
100 the cope and drag
110 the cope flask
112 the pin of the cope flask (the male jig for the positioning)
120 the drag flask
122 the bushing for the drag flask (the female jig for the positioning)
130 the carrier plate for the cope flask
132 the bushing of the carrier plate for the cope flask (the female jig for the positioning)
134 the pattern for the cope flask
136 the pattern plate for the cope flask
138 the leveling frame for the cope flask
139 the guide pin
140 the carrier plate for the drag flask
142 the pin of the carrier plate for the drag flask (the male jig for the positioning)
144 the pattern for the drag flask
146 the pattern plate for the drag flask
148 the leveling frame for the drag flask
149 the guide pin

The invention claimed is:

1. A method for preventing a defect caused by a shift in cavity parts in molding a cope and a drag with flasks by using a cope flask that is assembled with a carrier plate for the cope flask and a drag flask that is assembled with a carrier plate for the drag flask, comprising the steps of:

measuring a shift between the carrier plate for the cope flask and the cope flask;

measuring a shift between the carrier plate for the drag flask and the drag flask;

measuring a shift between the cope flask and the drag flask that have been assembled;

determining if a shift in cavity parts is within an allowable range, wherein the data on the shift is obtained based on the shift between the carrier plate for the cope flask and the cope flask, the shift between the carrier plate for the drag flask and the drag flask, and the shift between the cope flask and the drag flask that have been assembled.

2. The method for preventing a defect caused by a shift in cavity parts of claim 1, wherein the carrier plate for the cope flask and the cope flask is positioned in relation to each other by means of a male jig for the positioning and a female jig for the positioning, wherein the carrier plate for the drag flask and the drag flask is positioned in relation to each other by means of a male jig for the positioning and a female jig for the positioning, and wherein the cope flask and the drag flask are positioned in relation to each other by means of a male jig for the positioning and a female jig for the positioning.

3. The method for preventing a defect caused by a shift in cavity parts of claim 2, further comprising a step of measuring a degree of wear of the male jig for the positioning or the female jig for the positioning of any of the carrier plate for the cope flask, the cope flask, the carrier plate for the drag flask, and the drag flask.

4. The method for preventing a defect caused by a shift in cavity parts of claim 3, wherein an outer periphery of the male jig for the positioning or an inner periphery of the female jig for the positioning is measured in the step of measuring the degree of wear.

5. The method for preventing a defect caused by a shift in cavity parts of claim 3 or 4, further comprising a step of generating an alarm if the degree of wear of the male jig for the positioning or the female jig for the positioning is outside the allowable range.

6. The method for preventing a defect caused by a shift in cavity parts of claim 3 or 4, further comprising a step of linking the degree of wear of the male jig for the positioning or the female jig for the positioning to the cope flask or the drag flask that has that male jig for the positioning or that female jig for the positioning, so as to find a flask in which the male jig for the positioning or the female jig for the positioning should be exchanged during the maintenance of a line for molding a cope and a drag with flasks.

7. The method for preventing a defect caused by a shift in cavity parts of claim 4, further comprising a step of comparing respective shapes that have been found based on the measured values on the outer periphery of the male jig for the positioning and on the inner periphery of the female jig for the positioning with at least one of the measured shift between the carrier plate for the cope flask and the cope flask, the measured shift between the carrier plate for the drag flask and the drag flask, and the measured shift between the cope flask and the drag flask that have been assembled.

* * * * *